US009790904B2

(12) United States Patent
Park

(10) Patent No.: US 9,790,904 B2
(45) Date of Patent: Oct. 17, 2017

(54) DIESEL FUEL RECIRCULATION DEVICE

(71) Applicant: Hyundai Motor Company, Seoul (KR)

(72) Inventor: Yeon Seo Park, Jeonju-si (KR)

(73) Assignee: Hyundai Motor Company, Seoul (KR)

( * ) Notice: Subject to any disclaimer, the term of this patent is extended or adjusted under 35 U.S.C. 154(b) by 189 days.

(21) Appl. No.: 14/702,184

(22) Filed: May 1, 2015

(65) Prior Publication Data

US 2016/0138536 A1 May 19, 2016

(30) Foreign Application Priority Data

Nov. 14, 2014 (KR) ..... 10-2014-0158997

(51) Int. Cl.
*F02M 37/00* (2006.01)
*F02M 37/22* (2006.01)

(52) U.S. Cl.
CPC ..... *F02M 37/0052* (2013.01); *F02M 37/0035* (2013.01); *F02M 37/22* (2013.01)

(58) Field of Classification Search
CPC . F02M 37/0052; F02M 37/0035; F02M 37/22
See application file for complete search history.

(56) References Cited

U.S. PATENT DOCUMENTS 2,271,850 A * 2/1942 Zinkil ..... G05D 23/10 137/468
2,599,699 A * 6/1952 Dilworth ..... F02M 37/20 123/514
4,187,813 A * 2/1980 Stumpp ..... F02M 37/0035 123/510
4,456,216 A * 6/1984 Boruta ..... F02M 5/08 123/516
4,457,327 A * 7/1984 Pepper ..... A61L 2/26 137/67
4,618,417 A * 10/1986 Yamanouchi ..... F02M 31/16 210/149
5,887,573 A * 3/1999 Janik ..... F02D 33/006 123/514
5,988,514 A * 11/1999 Huang ..... G05D 23/1346 236/12.14
6,007,711 A * 12/1999 Atwood ..... B01D 27/06 123/514

(Continued)

FOREIGN PATENT DOCUMENTS

JP 2007-16658 A 1/2007
KR 20-1998-0027097 U 5/1998

(Continued)

*Primary Examiner* — Joseph Dallo
(74) *Attorney, Agent, or Firm* — Morgan, Lewis & Bockius LLP

(57) ABSTRACT

A diesel fuel recirculation device may include a fuel tank configured to store and supply diesel fuel, a main filter connected to the fuel tank and filter diesel fuel to supply the filtered diesel fuel to an engine, and a recirculation member provided in the main filter and be resupplied with high temperature fuel from the engine to supply the resupplied high temperature fuel to the fuel tank or the main filter, such that marketability and usage convenience may be improved by increasing a temperature of the fuel using the high temperature fuel resupplied from the engine to shorten a starting time under low temperature conditions.

8 Claims, 4 Drawing Sheets

(56) References Cited

U.S. PATENT DOCUMENTS

| | | | | |
|---|---|---|---|---|
| 6,289,879 | B1 * | 9/2001 | Clausen | F02M 31/16 123/514 |
| 7,971,849 | B2 * | 7/2011 | Yanagi | B01D 35/147 123/464 |
| 8,166,943 | B2 * | 5/2012 | Chamarthi | F02D 41/3845 123/179.17 |
| 8,186,332 | B2 * | 5/2012 | Sturgess | F02M 37/0035 123/196 A |
| 2007/0062494 | A1 | 3/2007 | Yanagi et al. | |
| 2011/0023833 | A1 * | 2/2011 | Chamarthi | F02D 41/3845 123/464 |
| 2011/0088800 | A1 * | 4/2011 | Core | B01D 36/005 137/613 |

FOREIGN PATENT DOCUMENTS

| | | | |
|---|---|---|---|
| KR | 10-2009-0052454 | A | 5/2009 |
| KR | 2011-0042948 | A | 4/2011 |

* cited by examiner

DIESEL FUEL RECIRCULATION DEVICE

CROSS-REFERENCE TO RELATED APPLICATION

The present application is based on and claims the benefit of priority to Korean Patent Application No. 10-2014-0158997, filed on Nov. 14, 2014, the entire contents of which is incorporated herein for all purposes by this reference.

BACKGROUND OF THE INVENTION

Field of the Invention

The present disclosure relates to a diesel fuel recirculation device, and more particularly, to a diesel fuel recirculation device capable of improving starting performance by increasing a temperature of fuel using high temperature fuel resupplied from an engine.

Description of Related Art

In general, a fuel supply module is a device installed in a fuel tank of a vehicle in order to supply diesel fuel in the tank to an engine.

Particularly, the fuel supply module is installed in the fuel tank to suck diesel fuel in the tank and then supplies the diesel fuel to the engine.

Therefore, the fuel supply module basically has a basic configuration in which a fuel pump and a supply tube for supplying the diesel fuel sucked by the fuel pump to the engine are coupled to each other.

However, in a fuel supply module according to the related art, in the case of diesel fuel, there was a problem in that when a temperature was low in the winder (−5 degrees in the summer, and −18 degrees in the winter), paraffin contained in diesel was precipitated to block an element of a fuel filter, such that the engine may not start.

In order to solve this problem, an electric coil is installed in the fuel filter to heat fuel, thereby solving the problem that the engine does not start. However, since a thawing time of about 20 to 30 minutes is consumed, there is still a problem in that marketability and convenience for starting are low.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a diesel fuel recirculation device a diesel fuel recirculation device capable of improving starting performance by increasing a temperature of fuel using high temperature fuel resupplied from an engine.

In an aspect of the present invention, a diesel fuel recirculation device may include a fuel tank configured to store and supply diesel fuel, a main filter connected to the fuel tank and filter the diesel fuel to supply the filtered diesel fuel to an engine, and a recirculation member provided in the main filter and be resupplied with high temperature fuel from the engine to supply the resupplied high temperature fuel to the fuel tank or the main filter.

The recirculation member may include an auxiliary filter configured to filter the high temperature fuel resupplied from the engine, and a thermal actual valve configured to supply the high temperature fuel filtered by the auxiliary filter to the fuel tank or the main filter according to a predetermined temperature.

The predetermined temperature is 30 degrees.

In a case in which a temperature of the high temperature fuel is equal to or higher than the predetermined temperature, the thermal actual valve is closed, such that the resupplied high temperature fuel is supplied to the fuel tank, and in a case in which the temperature of the high temperature fuel is lower than the predetermined temperature, the thermal actual valve is opened, such that the resupplied high temperature fuel is supplied to the main filter.

The main filter may include an inlet port connected to the fuel tank, and an outlet port connected to the engine.

The thermal actual valve may include a recirculation inlet port connected to the engine, and a recirculation outlet port connected to the fuel tank.

The thermal actual valve may include an actuator configured to open or close the recirculation outlet port, and a poppet provided to be movable from the actuator in a vertical direction to open or close the recirculation inlet port.

The thermal actual valve may include an actuator, a poppet engaged to the actuator and provided to be movable by the actuator, a first channel connecting the recirculation inlet port and the recirculation outlet port, and an opening formed on the first channel, wherein the poppet is provided to be selectively movable onto the opening to open or close the opening.

The main filter may further include a second channel connected to the inlet port of the main filter, wherein a second opening is formed on the second channel, and wherein the poppet is disposed away from the second opening.

The thermal actual valve may include an elastic body provided therein to recover a position of the poppet.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
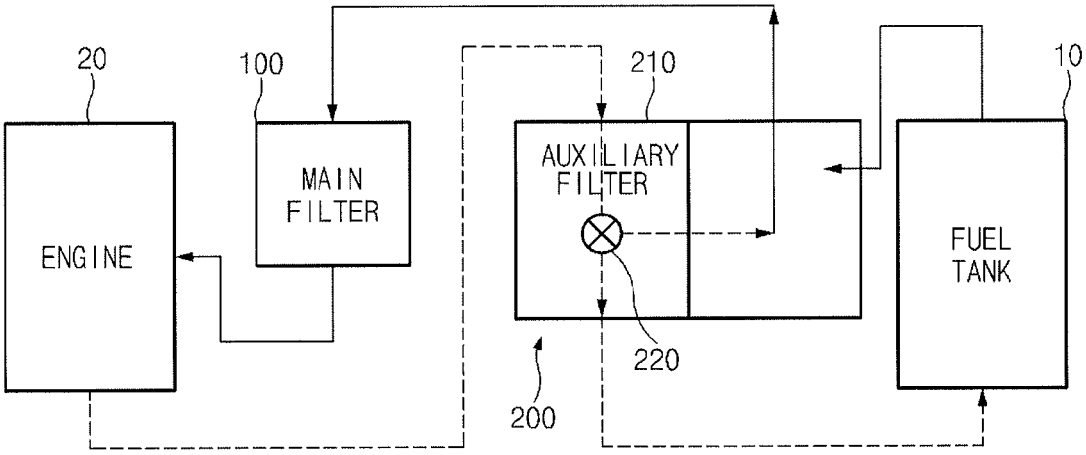
FIG. 1 is a structural view showing a diesel fuel recirculation device according to the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

An exemplary embodiment of the present disclosure will be described in detail with reference to the accompanying drawings.

Figure 2:
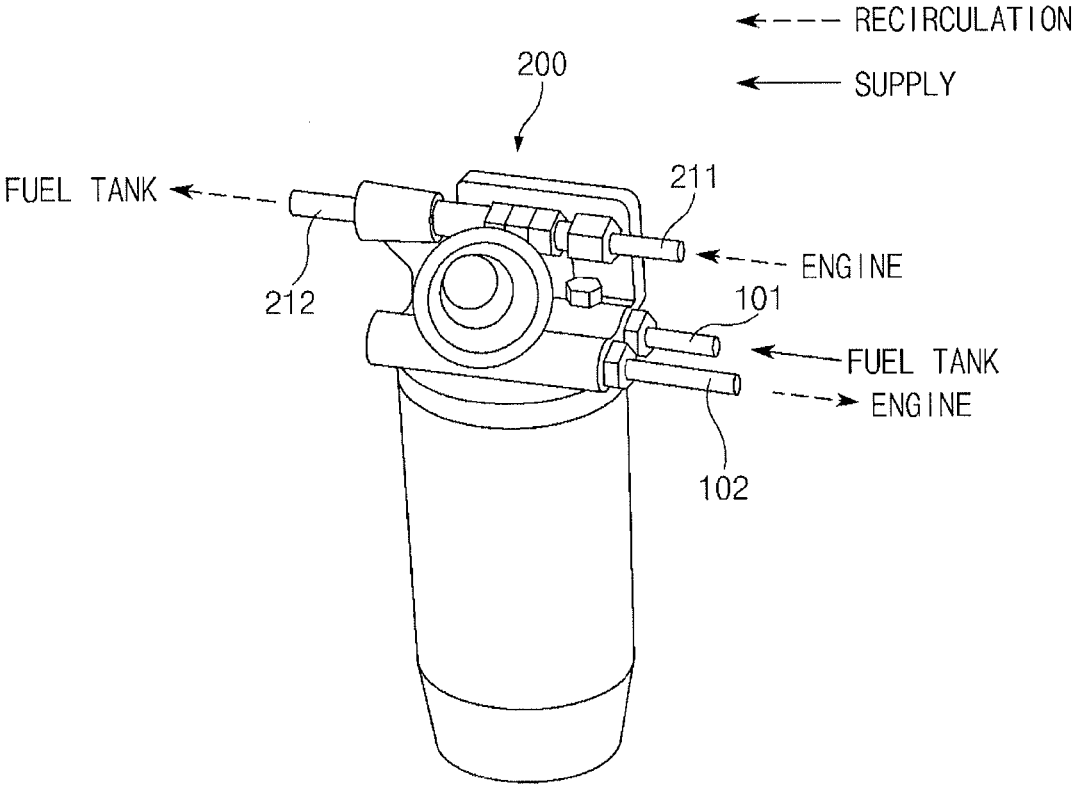
FIG. 2 is a view showing the diesel fuel recirculation device according to the present disclosure.
Figure 3:
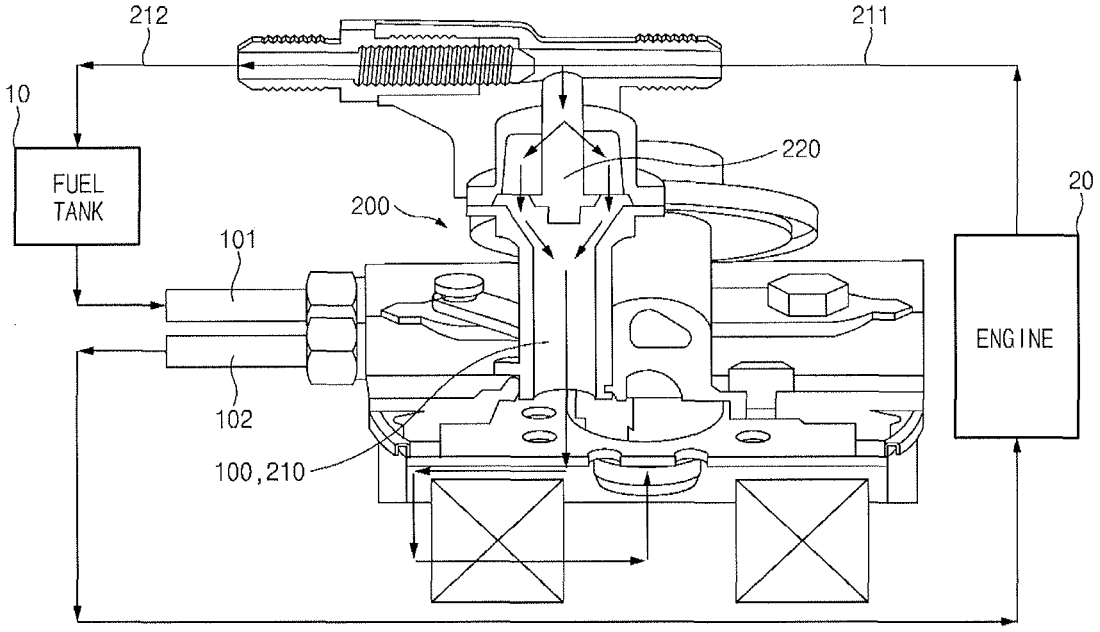
FIG. 3 is a cross-sectional view showing the diesel fuel recirculation device according to the present disclosure.

As shown in FIGS. 1 to 3, a diesel fuel recirculation device according to the present disclosure includes a fuel tank 10, a main filter 100 connected to the fuel tank 10, and a recirculation member 200 resupplied with high temperature fuel from an engine 20 to recirculate the high temperature fuel.

As shown in FIGS. 1 and 2, the fuel tank 10 is provided in a vehicle and stores diesel fuel to supply the diesel fuel to the engine 20 at the time of starting and driving.

The main filter 100 is connected to the fuel tank 10 and filters diesel fuel to supply the filtered diesel fuel to the engine 20.

The recirculation member 200 is provided in the main filter 100 and recirculates fuel by being resupplied with high temperature fuel from the engine 20 and supplying the resupplied high temperature fuel to the fuel tank 10 or the main filter 100.

In this case, the recirculation member 200 includes an auxiliary filter 210 and a thermal actual valve 220.

The auxiliary filter 210 filters the high temperature fuel resupplied from the engine 20.

The thermal actual valve 220 is connected to the auxiliary filter 210 to supply the high temperature fuel filtered by the auxiliary filter 210 to the fuel tank 10 or the main filter 100 according to a predetermined temperature.

Here, it is preferable that the predetermined temperature for high temperature fuel is set to 30 degrees.

In this case, it is preferable that when a temperature of high temperature fuel is 30 degrees or more, the thermal actual valve 220 is closed, such that the resupplied high temperature fuel is supplied to the fuel tank 10, and when the temperature is lower than 30 degrees, the thermal actual valve is opened, such that the resupplied high temperature fuel is supplied to the main filter 100.

Meanwhile, as shown in FIGS. 2 and 3, it is preferable that the main filter 100 includes an inlet port 101 connected to the fuel tank 10 and an outlet port 102 connected to the engine 20.

In addition, it is preferable that the thermal actual valve 220 includes a recirculation inlet port 211 connected to the engine 20 and a recirculation outlet port 212 connected to the fuel tank 10.

In this case, it is preferable that the thermal actual valve 220 includes an actuator 213 opening or closing the recirculation outlet port 212 and a poppet 214 provided so as to be movable from the actuator 213 in a vertical direction to open or close the recirculation inlet port 211.

Here, the thermal actual valve 220 may include an elastic body 215 provided therein, such that after the poppet 214 is moved, a position of the poppet 214 may be recovered.

That is, according to an exemplary embodiment of the present invention, at the time of a low temperature (−5° C. or less), when paraffin is precipitated in diesel fuel introduced into the main filter 100 through the inlet port 101 from the fuel tank 10 and blocks a filter paper to hinder fuel supply, a phenomenon that paraffin is precipitated in the fuel is prevented by supplying some of the diesel fuel (about 90° C. or more) recovered from the engine 20 through the recirculation inlet port 211 to the auxiliary filter 210 through the thermal actual valve 220 to heat low temperature fuel introduced through the inlet port 101, such that the fuel may be normally supplied without generating a phenomenon that paraffin blocks the filter paper.

In addition, after a predetermined time elapses, when the fuel tank 10 is heated by the fuel recovered from the engine 20 to thereby be in state in which paraffin is not precipitated any more in the filter, the thermal actual valve 220 is pushed upwardly, such that the fuel is recovered in the fuel 10 tank by the recirculation outlet port 212.

Figure 4:
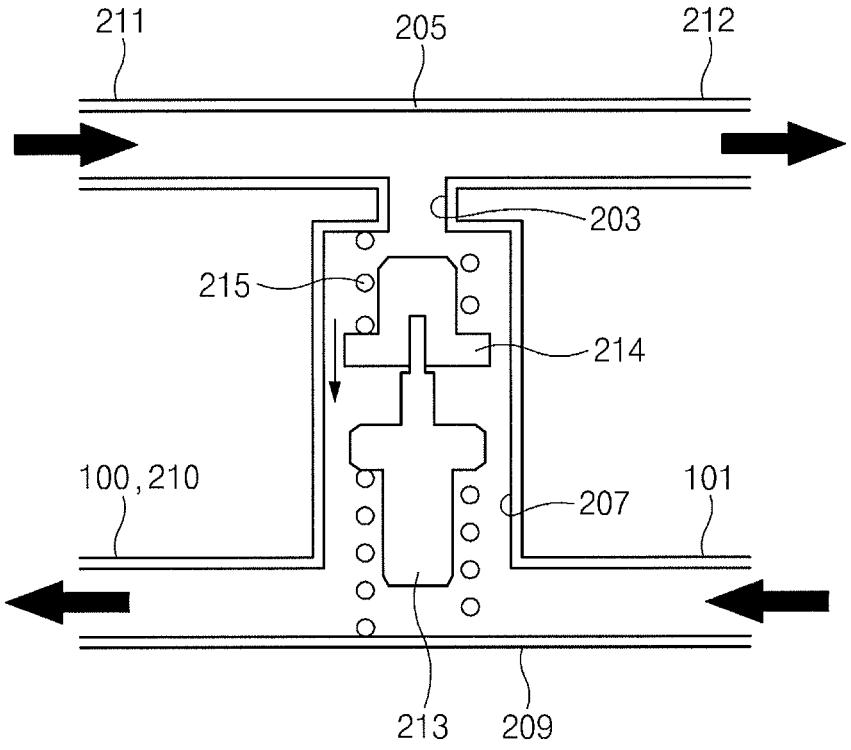
FIG. 4 is a cross-sectional view showing a low temperature state in the diesel fuel recirculation device according to the present disclosure.
Figure 5:
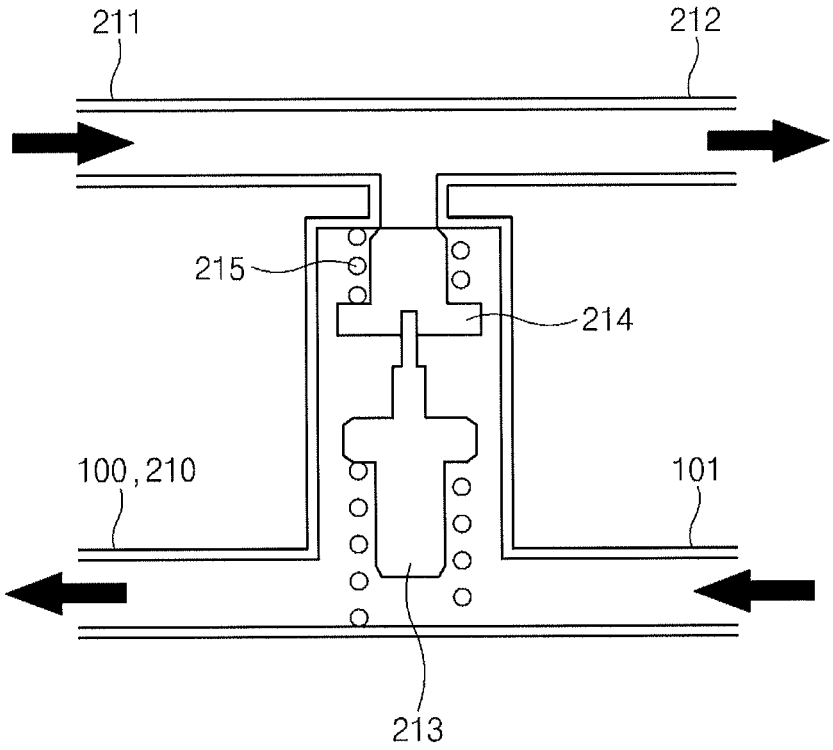
FIG. 5 is a cross-sectional view showing a high temperature state in the diesel fuel recirculation device according to the present disclosure.

In this case, at a low temperature, as shown in FIG. 4, a liquid of which thermal expansion is constant in the actuator 213 is contracted and the poppet 214 is pushed down by force of a spring, such that the recirculation outlet port 212 is opened, and as shown in FIG. 5, at a high temperature, the liquid is expanded to push the poppet 214 upwardly, such that the recirculation outlet port 212 is closed.

Therefore, a function of closing and opening the recirculation outlet port 212 is controlled by the thermal actual valve 220. At a low temperature, the thermal actual valve 220 is opened, and some of the recovered high temperature fuel is directly introduced into the auxiliary filter 210 to increase a temperature of the auxiliary filter 210, and at a high temperature, the thermal actual valve 220 is closed, and the diesel fuel recovered from the engine 20 is directly recovered into the fuel tank 10.

When the thermal actual valve 220 is not closed at a high temperature, in the case in which the filter paper is exposed to an excessively high temperature for a long period of time, a lifetime of the filter paper may be decreased. Therefore, it is preferable that the thermal actual valve 220 has a structure in which the thermal actual valve 220 is closed at a normal temperature.

Meanwhile, temperatures at which the valve 220 is opened and closed are determined through various experiments (opening: 26.7 degrees, and closing: 43.3 degrees), and a desired operation temperature may be obtained by adjusting force of the elastic body 215 and an amount of the liquid in the thermal actual valve 220.

As described above, according to the present disclosure, the diesel fuel recirculation device includes the fuel tank 10 storing and supplying diesel fuel, the main filter 100 connected to the fuel tank 10 and filtering diesel fuel to supply the filtered diesel fuel to the engine 20, and the recirculation member 200 provided in the main filter 100 and resupplied with high temperature fuel from the engine 20 to supply the resupplied high temperature fuel to the fuel tank 10 or the main filter 100, wherein the recirculation member 200 includes the thermal actual valve 220, and the thermal actual valve is opened at a predetermined temperature or less to thereby supply the high temperature fuel (about 90 degrees or more) resupplied from the engine 20 to the fuel filter, but in the case in which the temperature of the fuel supplied from the fuel tank 10 to the fuel filter is about 30 degrees or more, the thermal actual valve 220 is closed, and fuel returned from the engine 20 is directly recovered into the fuel tank 10. Therefore, the fuel resupplied from the engine 20 heats cool fuel supplied from the fuel tank 10 to prevent formation of paraffin, such that the starting time under the low temperature conditions may be shortened, thereby making it possible to improve marketability and usage convenience.

In an exemplary embodiment of the present invention, a first opening 203 may be formed on a first channel 205 connecting the recirculation inlet duct 211 and recirculation outlet port 212 and the poppet 214 is selectively placed on the opening 203. Accordingly, when the poppet 214 is opened at a predetermined temperature or less, the high temperature fuel (about 90 degrees or more) is resupplied from the engine 20 to the fuel filter through the opening 203. However, in the case in which the temperature of the fuel supplied from the fuel tank 10 to the fuel filter is about 30 degrees or more, the poppet 214 is closed, and fuel returned from the engine 20 is directly recovered into the fuel tank 10.

In an exemplary embodiment of the present invention, the main filter 100 further includes a second channel 209 connected to the inlet port 101 of the main filter, wherein a second opening 207 may be formed on the second channel 209 and the poppet 214 is disposed away from the second opening 207.

As set forth above, according to the exemplary embodiment of the presents of the present disclosure, marketability and usage convenience may be improved by increasing the temperature of fuel using the high temperature fuel resupplied from the engine to shorten the starting time under the low temperature conditions.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A diesel fuel recirculation device comprising:

a fuel tank configured to store and supply diesel fuel;

a main filter connected to the fuel tank and filter the diesel fuel wherein the filtered diesel fuel is supplied to an engine through the main filter; and a recirculation member provided in the main filter and resupplied with heated fuel from the engine to supply the resupplied heated fuel to the fuel tank, wherein the recirculation member includes:

an auxiliary filter configured to filter the heated fuel resupplied from the engine; and a thermal actual valve configured, according to a predetermined temperature of the heated fuel, to supply the heated fuel filtered by the auxiliary filter to the fuel tank or the main filter, and wherein the main filter includes:

an inlet port connected to the fuel tank; and an outlet port connected to the engine, and wherein a phenomenon that paraffin is precipitated in the diesel fuel is prevented by supplying a portion of the diesel fuel recovered from the engine to the auxiliary filter through the thermal actual valve.

2. The diesel fuel recirculation device according to claim 1, wherein the predetermined temperature is 30 degrees in Celsius.

3. The diesel fuel recirculation device according to claim 1, wherein in a case in which a temperature of the heated fuel is equal to or higher than the predetermined temperature, the thermal actual valve is closed, such that the resupplied heated fuel is supplied to the fuel tank, and in a case in which the temperature of the heated fuel is lower than the predetermined temperature, the thermal actual valve is opened, such that the resupplied heated fuel is supplied to the main filter.

4. The diesel fuel recirculation device according to claim 1, wherein the thermal actual valve includes:

a recirculation inlet port connected to the engine; and a recirculation outlet port connected to the fuel tank.

5. The diesel fuel recirculation device according to claim 1, wherein the thermal actual valve includes:

an actuator configured to open or close the recirculation outlet port; and a poppet provided to be movable from the actuator in a vertical direction to open or close the recirculation inlet port.

6. The diesel fuel recirculation device according to claim 1, wherein the thermal actual valve includes:

an actuator;

a poppet engaged to the actuator and provided to be movable by the actuator;

a first channel connecting the recirculation inlet port and the recirculation outlet port; and an opening formed on the first channel, wherein the poppet engaged to the actuator is provided to be selectively movable by the actuator onto the opening to open or close the opening.

7. The diesel fuel recirculation device according to claim 6, wherein the main filter further includes a second channel connected to the inlet port of the main filter, wherein a second opening is formed on the second channel, and wherein the poppet is spaced from the second opening.

8. The diesel fuel recirculation device according to claim 5, wherein the thermal actual valve includes an elastic body provided therein to recover a position of the poppet.

* * * * *